US006389717B2

(12) United States Patent
Maier et al.

(10) Patent No.: US 6,389,717 B2
(45) Date of Patent: May 21, 2002

(54) WATER FILLING ORIFICE FOR STEAM PRESSING IRON

(75) Inventors: Klaus Maier, Offenbach; Herbert Horn, Erbach-Lauerbach; Reinhard Ahlers, Offenbach; Ralf Kremer, Seligenstadt, all of (DE)

(73) Assignee: Rowenta Werke GmbH, Offenbach (DE)

( * ) Notice: Subject to any disclaimer, the term of this patent is extended or adjusted under 35 U.S.C. 154(b) by 0 days.

(21) Appl. No.: 09/816,668

(22) Filed: Mar. 26, 2001

(30) Foreign Application Priority Data

Mar. 28, 2000 (DE) ..... 100 15 078

(51) Int. Cl.[7] ..... D06F 75/14
(52) U.S. Cl. ..... 38/88; 38/77.4
(58) Field of Search ..... 38/88, 77.8, 77.3, 38/77.4, 77.5; 264/DIG. 57, DIG. 76

(56) References Cited

U.S. PATENT DOCUMENTS 2,861,365 A * 11/1958 Block ..... 38/77.82
4,233,763 A * 11/1980 McMullen ..... 38/93
4,748,755 A 6/1988 Bain, Jr. et al.
6,243,976 B1 * 6/2001 Beverly et al. ..... 38/77.5

FOREIGN PATENT DOCUMENTS

| | | |
|---|---|---|
| DE | 26 05 443 | 8/1977 |
| FR | 2 318 970 | 2/1977 |
| FR | 2 632 331 | 12/1989 |
| FR | 2 705 975 | 12/1994 |
| JP | 60 41992 | 5/1985 |
| JP | 61 164598 | 7/1986 |
| JP | 61 263494 | 11/1986 |
| JP | 61 265197 | 11/1986 |

OTHER PUBLICATIONS

Patent Abstracts of Japan, Application No. 4 137117, Publication Date Dec. 14, 1993.

* cited by examiner

*Primary Examiner*—Ismael Izaguirre
(74) *Attorney, Agent, or Firm*—Browdy and Neimark

(57) ABSTRACT

A filling orifice structure in a clothes pressing iron having a water reservoir, the structure having: an orifice body providing a filling orifice for filling the reservoir; a closing piece mounted for movement between an open position for opening said filling orifice and a closed position for closing the filling orifice; and at least one sealing joint overmolded onto the orifice body and disposed to provide a fluid seal between the body and the closing piece.

14 Claims, 4 Drawing Sheets fig 2
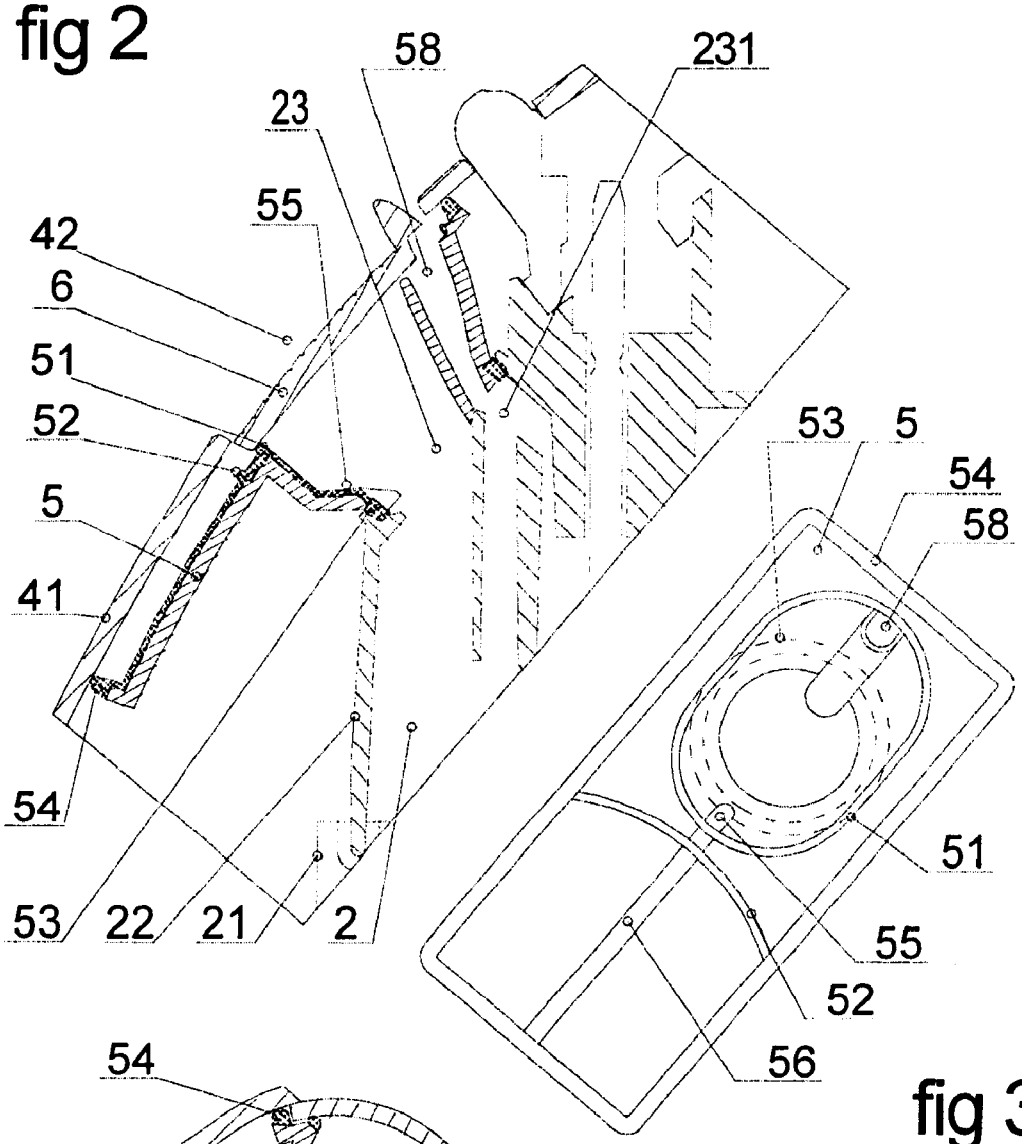
fig 3
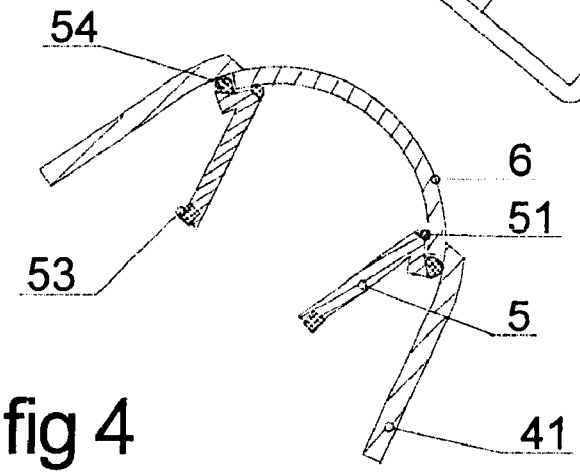
fig 4

WATER FILLING ORIFICE FOR STEAM PRESSING IRON

BACKGROUND OF THE INVENTION

The present invention relates to steam pressing irons having an integrated water reservoir, and relates more particularly to a filling orifice, or opening, via which the reservoir can be filled.

Steam pressing irons generally have an electrically heated soleplate, a reservoir for holding water that is to be converted into steam and that is to flow through a droplet delivery system toward a steam generating chamber, and an envelope, or casing, having a handle for grasping and operating the iron, along with an orifice permitting refilling of the reservoir. Certain pressing irons. such as those disclosed in French patents FR 2 632 331 and FR 2 705 975, can have several reservoirs for storing different types of liquids.

Herein, in the interest of simplification, the invention will be described with regard to one orifice for replenishing water in a steam iron reservoir. However, it is to be understood that the invention can be extended to every orifice provided for replenishing one or more liquids in a steam pressing iron.

For filling a reservoir, it is necessary to place the exterior surface of the casing in liquid flow communication with an upper part of the reservoir and to prevent water from splashing out of the reservoir when the iron is in use.

There are known pressing irons in which the filling orifice is provided in a structure in the form of a funnel that is connected to the reservoir by a tubing provided with elbows and a certain length to prevent water from easily being spilled out of the iron. Often a second tube connects the reservoir to a passage disposed in proximity to the funnel to serve as a vent though which air may be expelled from the reservoir during filling. However, this system has the drawback of limiting the speed of a refilling operation and requiring the assembly of tubular parts during manufacture. These tubular parts could be replaced by shorter baffles. The molding of a one-piece element having baffles, an air vent conduit and the form of a funnel, such as described for example in the German patent DE 2605443, permits an economical assembly, but the baffles slow the refilling operation, which becomes difficult, and their effectiveness is limited.

Arrangements having an orifice closure are more effective. For example, in French patent FR 2 318 970 and Japanese patents JP 61265197 and JP 60041992, closing of an orifice is assured by a collar, a rotatable cap, or a pivoting cover. Japanese patents JP 61164598 and JP 61263494 disclose arrangements in which the closing is assured by a sliding cap. However, achievement of sufficient tightness with these closing pieces requires a high precision manufacturing operation that does not allow for large manufacturing tolerances and requires delicate arrangements for stopping or for maintaining these pieces in the open and closed positions. With wear, leaks can develop during ironing movements.

BRIEF SUMMARY OF THE INVENTION

An object of the present invention is to provide an orifice structure that permits rapid refilling of a reservoir and that eliminates the above-mentioned shortcomings while being easy to fabricate and install.

The above and other objects are achieved, according to the present invention, by a filling orifice structure in a clothes pressing iron having a water reservoir, the structure comprising: an orifice body providing a filling orifice for filling the reservoir; a closing piece mounted for movement between an open position for opening said filling orifice and a closed position for closing the filling orifice; and at least one sealing joint overmolded onto the orifice body and disposed to provide a fluid seal between the body and the closing piece.

The presence of a joint prevents water from beading around the closing piece, as a result of an inaccurate adjustment with the body or as a result of deformations that occur as an incident to aging of the appliance. Overmolding on the body permits an automatic assemblage on a mass production basis with a high degree of assurance that no leak can be produced between the joint and the body and incorrect positioning of the joint cannot occur.

Preferably, a first lip of the joint surrounds the filling orifice. This first lip assures the primary sealing of the body with the closing piece.

Preferably, a second lip of the joint or another lip of a second overmolded joint assures guidance of the closing piece during opening and closing of the orifice. This second joint lip provides, at the same time, an improved seal and a better guidance of the closing piece.

Preferably, the closing piece slides with slight friction on the overmolded joint or joints during opening and closing of the orifice.

The closing piece is retracted by sliding along the body of the orifice, with light friction on the lip or lips of the joint or joints. The gentle friction permits the closing piece to be retained naturally in place and more particularly in the closed position or the open position. The overmolded joints are firmly fixed without play to the body of the orifice. They are not displaced or rolled during the opening and closing movements, which assures the gentleness of the displacement. Preferably, the orifice body includes a conduit for venting the reservoir.

This arrangement permits a rapid filling, the filling orifice being capable of being entirely available for the flow of liquid without interference from air escaping from the reservoir.

Preferably, the orifice body also has an overmolded joint intended to assure a seal between the body and the reservoir. The number of parts required to perform all sealing functions can thus be limited. The orifice body can be a piece that is different from the casing of the iron.

Preferably, another joint overmolded onto the orifice body can assure a seal between the orifice body and the casing of the iron or a part of the casing of the iron.

Usefully, the overmolded joints that assure the seal of the body with the reservoir, with the closing piece and with the casing of the iron are made of the same material and are connected together by one or more connecting tongues of the same material. The, or each, connecting tongue assures and additional attachment of the joint on the orifice body and permits, by the continuity that it creates, injection molding of the various joints at a single injection point and in a single molding operation. As a result, the fabrication procedure is facilitated.

Preferably the overmolded joint or joints are of a thermoplastic elastomer (TPE) material. Thermoplasticity is an essential property to allow the overmolding and adherence on the orifice body. Preferably, the thermoplastic material has a Shore A hardness between 40 and 55. Preferably, the orifice body is madder of an ABS (acrylonitrile butadiene styrene) plastic. The thermoplastic elastomer material of the joint adheres well to this material, which has, in addition, a pleasing appearance.

BRIEF DESCRIPTION OF THE DRAWINGS

FIG. 2 is a cross-sectional elevational detail view of a portion of the orifice structure shown in FIG. 1.

FIG. 3 is top plan detail view of the orifice structure shown in FIG. 1.

FIG. 4 is a cross-sectional view in a plane perpendicular to the longitudinal plan of the iron and containing the axis of the filling orifice structure according to the invention.

DETAILED DESCRIPTION OF THE INVENTION

Figure 1:
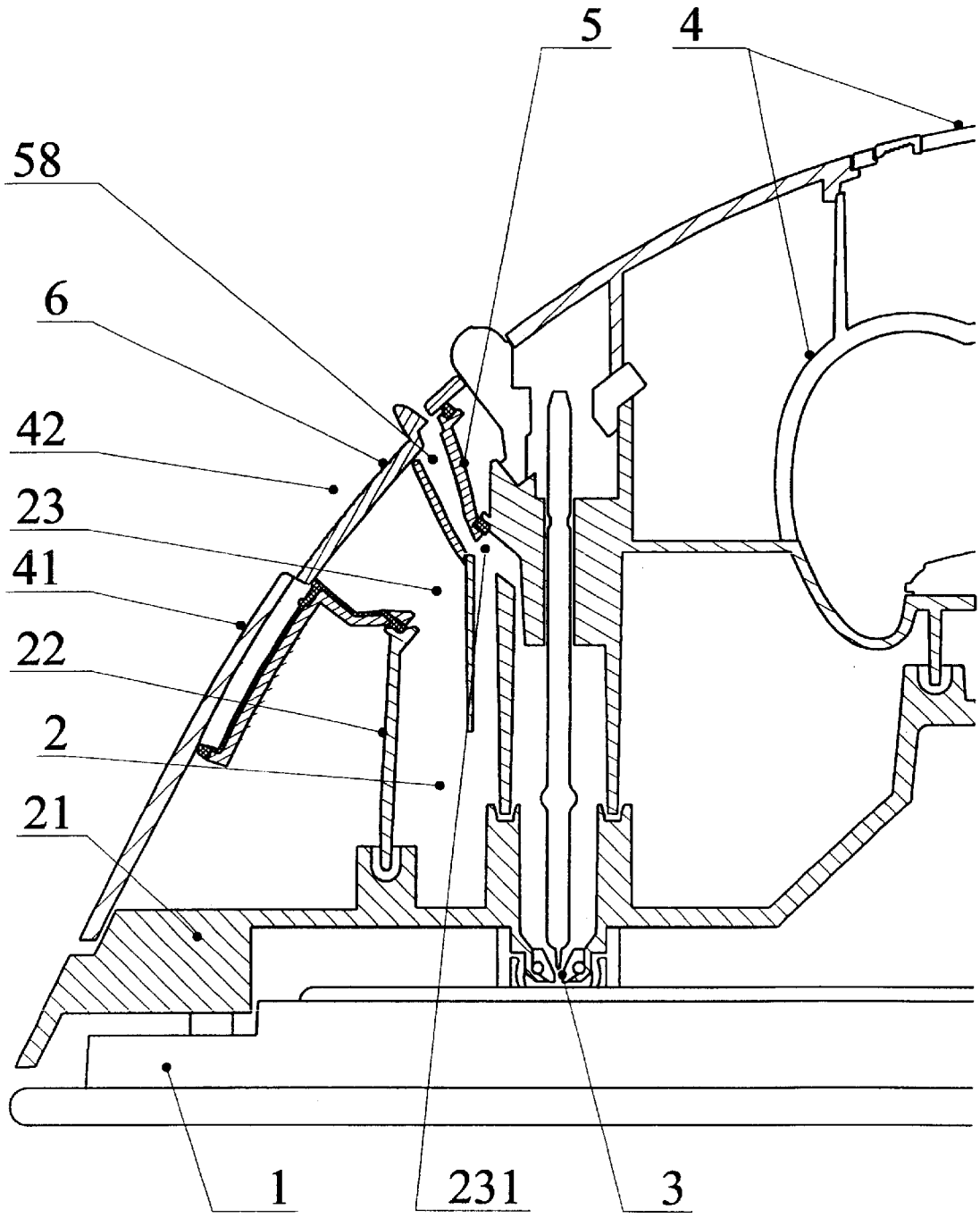
FIG. 1 is a cross-sectional elevational view of the front portion of a steam pressing iron equipped with a filling orifice structure according to the present invention.
Figure 5:
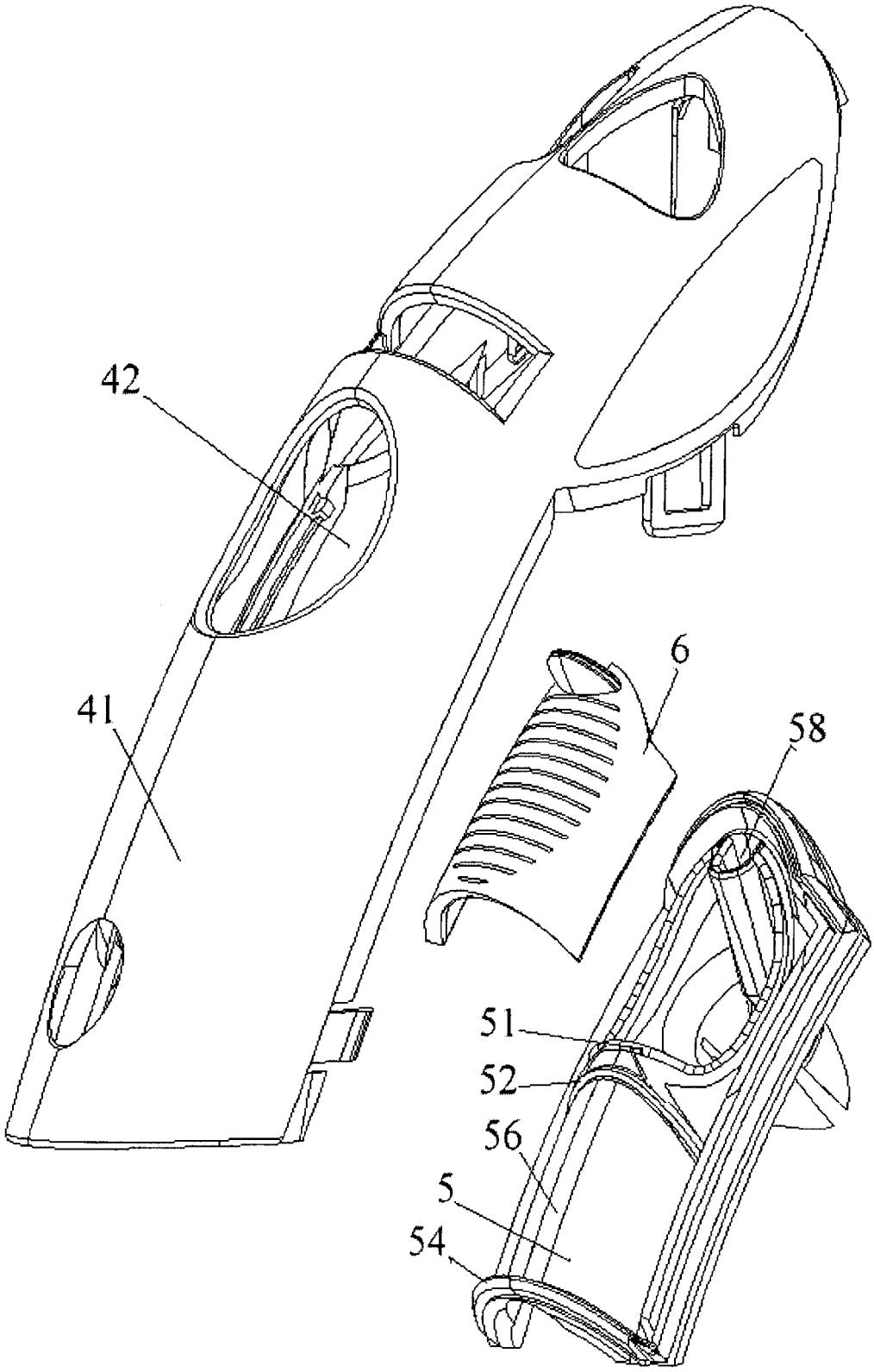
FIG. 5 is an exploded, perspective view, seen from above and to the side, showing the filling orifice structure according to the invention, along with an associated casing part of the iron.
Figure 6:
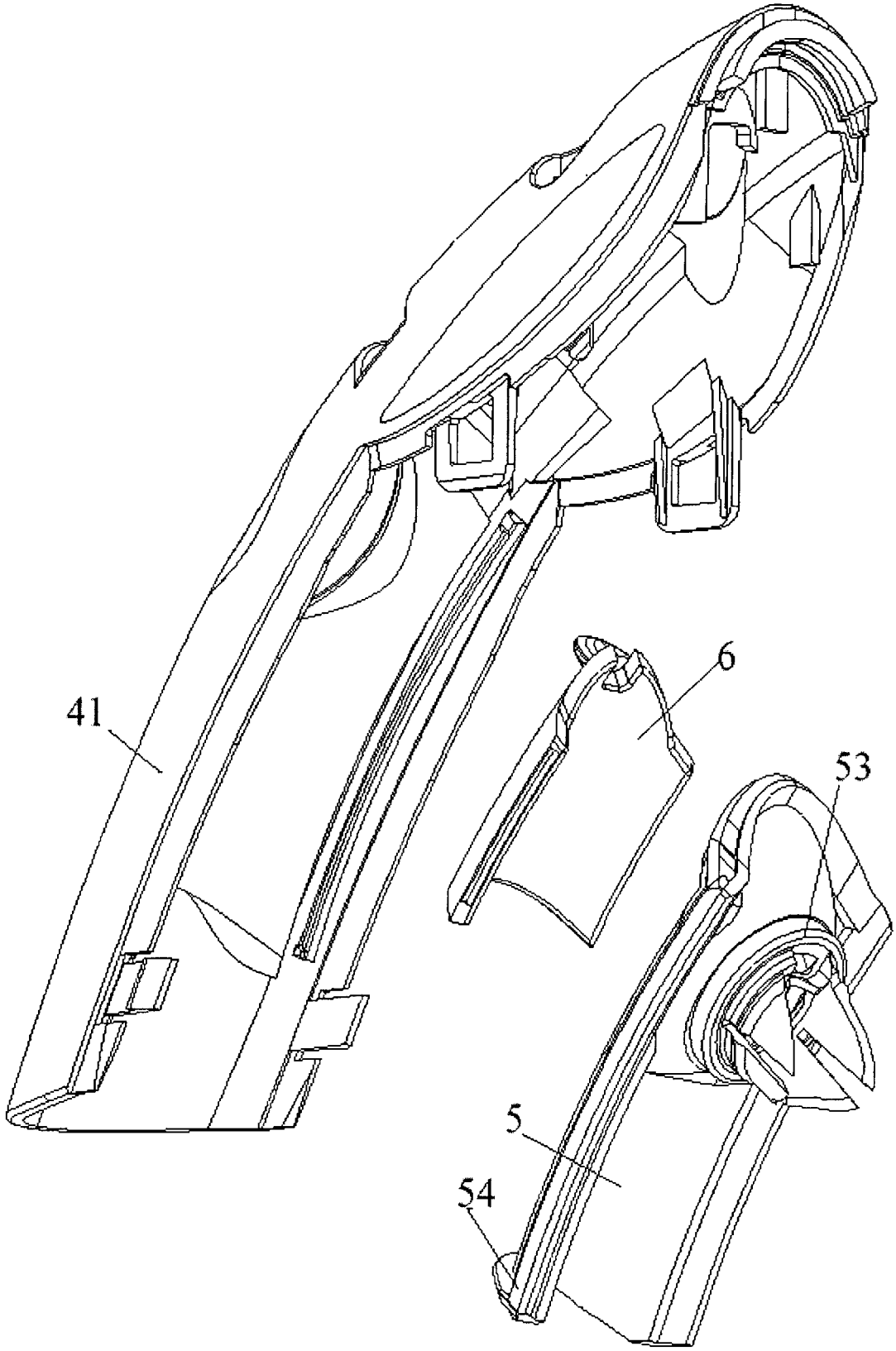
FIG. 6 is an exploded, perspective view, seen from below and to the side, showing the same components as FIG. 5.

A preferred embodiment of the invention is illustrated in FIGS. 1–6. As shown in FIG. 1, a pressing iron, preferably a steam iron, has a subassembly 1 including a soleplate and a heating body with a steam generating chamber, a water reservoir 2 made of two pieces 21 and 22 that are assembled together, and a dispensing device 3 that dispenses water in the form of drops at a controlled rate from reservoir 2 to the steam generating chamber. All of the components described above can be constructed in a manner that is conventional in the art.

At the front of the iron, an orifice 23 for reservoir 2 permits refilling of the reservoir at a high point whether the iron is in its raised, rest position or in its ironing position. The iron also includes a casing that has a handle (not shown) for grasping the iron. This casing is composed of a main part 4. Toward the front of the iron, in the vicinity of orifice 23, the casing has a part 41 providing a passage 42 in alignment with orifice 23.

The hydraulic communication between passage 42 of envelope part 41 and orifice 23 is formed, as shown in FIG. 1 and 2, by an orifice body 5 preferably made of ABS plastic, has the form of a funnel that facilitates flow of the water into reservoir 2. Usefully, orifice body 5 includes a vent conduit 58 permitting air to escape from reservoir 2 during filling. This conduit 58 corresponds with a vent passage 231 adjacent orifice 23 for reservoir 2.

A closing piece 6 sliding between casing part 41 and orifice body 5 permits opening or sealed closing of passage 42. Fluid tight connections are formed between orifice body 5 and closing piece 6, reservoir 2 and the casing, including casin part 41, by thermoplastic elastomer joints, or seals, overmolded onto orifice body 5. A first joint 51, shown in a front view in FIG. 3 and in a side view in FIG. 4, is overmolded onto orifice body 5 around passage 42. This joint assures a fluid tight seal between closing piece 6 and body 5.

An extension of joint 51 comprising a lip 52 is overmolded on the zone over which closing piece 6 moves and usefully covers the entire width of this zone. This lip 52 is disposed in a manner to bear against closing piece 6 when closing piece 6 is moved away from the portion of joint 51 that surrounds the passage 42 during opening of that passage. In addition, closing piece 6 is confined to its desired displacement path by casing part 41 and, as can be in FIGS. 2 and 4, moves in frictional engagement with joint 51 and its lip 52 during displacements between the open and closed positions.

A second joint 53 of the same material as joint 51 is overmolded on orifice body 5 around orifice 23. This joint assures the fluid tightness of the seal between reservoir 2 and orifice body 5. Joints 51 and 52 are joined together by at least one tongue 55 of the same material as the joints.

A third joint 54 of the same material as joints 51 and 53 is overmolded on the periphery of orifice body 5 and assures the fluid tightness of a seal between casing part 41 and body 5. At least one tongue 56 of the same material as the joints is formed as an extension of tongue 55 and connects joint 54 to the other joints.

When reservoir 2 must be filled, the user slides closing piece 6 along and between body 5 and casing part 41. Closing piece 6 slides while experiencing a slight friction from joint 51 and lip 52. According to preferred embodiments of the invention, the contact force between closing piece 6 and joint 51, and particularly lip 52, is set so that the force needed to slide closing piece 6 between its open and closed positions, at least after movement has started, is between 150 and 300 grams. In a practical embodiment that has been fabricated, the force was around 240 grams. Since joint 51 and its lip 52 are overmolded onto body 5, they yield slightly without being displaced. Closing piece 6 will move smoothly to its opening position since the contact force between opening piece and body 5 will not vary abruptly. At the ends of its travel path, closing piece 6 no longer rubs against lip 52 and rubs only in a partial manner against the remainder of joint 51. Lip 52 provides a lateral support for closing piece 6 over its entire width and exposes closing piece 6 to a constant low friction level until closing piece 6 has moved fully to the open position. Closing piece 6 having been brought to the position for opening the filling orifice, remains in this position as a result of the gentle friction provided by joint 51. As a result, additional elements for maintaining closing piece 6 in the open position are not needed. For these same reasons, after closing, joint 51 and its associated lip 52 assure maintenance of closing piece in the closed position.

Connection tongues 55 and 56 between joints 51–54 permit all of the joints, and the tongues, to be overmolded in a single injection molding operation. In addition, they reinforce the connection of the joints with orifice body 5. The ABS plastic material selected for orifice body 5 helps to assure a good connection with the elastomer of the various joints.

During filling of reservoir 2, body 5 guides the flow of water towards reservoir 2 and joints 53 and 54 assure that no water will leak inside the iron in the regions surrounding reservoir 2. These flexible elastomer joints conform well to the parts that they seal, without a high degree of precision being needed during their manufacture.

The flow of water can completely fill the cross-section of the orifice since air that was trapped in the reservoir will be permitted to escape to the outside through passage 231 and vent conduit 52 of orifice body 5, which allows a more rapid and easy filling of reservoir 2.

After filling, the user closes the orifice with closing piece 6. Joint 51 then assures that closing piece 6 will be maintained in place and that a tight seal will be formed between orifice body 5 and closing piece 6. Subsequently, during operation of the iron, even if water in reservoir 2 should become agitated and flow into orifice 23, it will prevented form spilling out of the iron by closing piece 6.

Installation of orifice body 5 during manufacture of the iron is quite simple since it only need be fitted onto reservoir 2 via joint 53, after which closing piece 6 is placed in position and casing 41 is installed.

Thus, the present invention provides a pratical filling orifice body that is made of a small number of pieces, is easy to fabricate and install and provides an efficient closing of the reservoir filling orifice.

This application relates to subject matter disclosed in German Application No. DE-100 15 078.0, filed Mar. 28, 2000, the entirety of which is incorporated herein by reference.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention. Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

What is claimed is:

1. A filling orifice structure in a clothes pressing iron having a water reservoir, said structure comprising:

an orifice body providing a filling orifice for filling the reservoir;

a closing piece mounted for movement between an open position for opening said filling orifice and a closed position for closing said filling orifice; and at least one sealing joint overmolded onto said orifice body and disposed to provide a fluid seal between said body and said closing piece.

2. The filling orifice structure of claim 1, wherein said at least one overmolded sealing joint surrounds the filling orifice.

3. The filling orifice structure of claim 2, wherein said at least one overmolded sealing joint comprises a first lip disposed to guide said closing piece during movement between the open position and the closed position.

4. The filling orifice structure of claim 1, wherein said orifice body is constructed to allow said closing piece to slide while encountering a low level of friction on said at least one sealing joint.

5. The filling orifice structure of claim 1, wherein said orifice body further comprises a vent conduit for allowing escape of air from the reservoir during filling.

6. The filling orifice structure of claim 1, wherein said orifice body further comprises at least one additional sealing joint overmolded onto said orifice body and disposed to provide a fluid seal between said body and the reservoir.

7. The filling orifice structure of claim 1, wherein the iron further has an external casing and said orifice body further comprises an additional sealing joint overmolded onto said orifice body and disposed to provide a fluid seal between said body and the casing.

8. The filling orifice structure of claim 1, wherein the iron further has an external casing and said orifice body further comprises additional sealing joints overmolded onto said orifice body and disposed to provide a fluid seal between said body and the reservoir and between said and the external casing, and tongues connecting said sealing joints together.

9. The filling orifice structure of claim 8, wherein said sealing joints and said tongues are made of a thermoplastic elastomer material.

10. The filling orifice structure of claim 9, wherein said thermoplastic elastomer material has a Shore A hardness between 40 and 55.

11. The filling orifice structure of claim 1, wherein said orifice body is made of ABS plastic.

12. The filling orifice structure of claim 1, wherein said sealing joint is made of a thermoplastic elastomer material.

13. The filling orifice structure of claim 12, wherein said thermoplastic elastomer material has a Shore A hardness between 40 and 55.

14. The filling orifice structure of claim 2, wherein said at least one overmolded sealing joint is injection molded onto said orifice body.

* * * * *